US005746270A

United States Patent [19]

Schroeder et al.

[11] Patent Number: 5,746,270

[45] Date of Patent: May 5, 1998

[54] HEAT EXCHANGER FOR MARINE ENGINE COOLING SYSTEM

[75] Inventors: Bruce A. Schroeder; James Michael Horak, both of Stillwater, Okla.

[73] Assignee: Brunswick Corporation, Lake Forest, Ill.

[21] Appl. No.: 591,963

[22] Filed: Jan. 30, 1996

[51] Int. Cl.[6] ..... B63H 21/10; B63H 21/38; F28F 9/06; F28F 21/06

[52] U.S. Cl. ..... 165/41; 165/51; 165/104.32; 165/158; 165/174; 165/917; 123/51.54; 123/41.08; 440/88

[58] Field of Search ..... 165/41, 51, 104.17, 165/104.32, 158, 174, 917; 123/41.54; 440/88

[56] References Cited

U.S. PATENT DOCUMENTS

| | | | |
|---|---|---|---|
| 3,319,614 | 5/1967 | Shanahan | 123/41.08 |
| 3,358,654 | 12/1967 | Shanahan et al. | 123/41.08 |
| 3,918,418 | 11/1975 | Horn | 123/41.08 |
| 3,939,901 | 2/1976 | Cieszko et al. | 123/41.54 |
| 4,220,121 | 9/1980 | Maggiorana | 123/41.8 |
| 4,306,614 | 12/1981 | Maggiorana | 165/35 |
| 4,312,304 | 1/1982 | Tyner | 123/41.74 |
| 4,320,798 | 3/1982 | Obernberger | 165/36 |
| 4,553,585 | 11/1985 | Pfleger et al. | 165/41 |
| 4,674,449 | 6/1987 | Hundertmark | 123/41.08 |
| 4,763,724 | 8/1988 | Temmesfeld et al. | 165/104.32 |
| 5,004,042 | 4/1991 | McMorries, IV et al. | 165/41 |
| 5,329,888 | 7/1994 | Luckett et al. | 123/41.08 |
| 5,642,691 | 7/1997 | Schroeder | 123/41.09 |

*Primary Examiner*—John K. Ford
*Attorney, Agent, or Firm*—Andrus, Sceales, Starke & Sawall

[57] ABSTRACT

A heat exchanger assembly is provided for a marine propulsion system having a closed loop cooling system. The heat exchanger body encloses a series of tubes carrying sea water which removes heat from the engine coolant. The heat exchanger includes an integrally connected top tank. A single venting orifice is provided into the top tank from the heat exchanger body. A heat exchanger coolant outlet is in direct fluid communication with both a system bypass and the coolant in the top tank. An auxiliary inlet for coolant from the top tank is located in the heat exchanger coolant outlet downstream of the bypass inlet, thereby promoting the ability of the system to draw coolant through the top tank rather than the bypass. The invention minimizes cavitation and reduces the creation of negative pressure at the circulating pump.

11 Claims, 4 Drawing Sheets

HEAT EXCHANGER FOR MARINE ENGINE COOLING SYSTEM

BACKGROUND OF THE INVENTION

The invention relates to a heat exchanger for a pressurized, closed loop cooling system for an internal combustion engine in a marine propulsion system.

Inboard mounted marine propulsion engines may advantageously be provided with a closed loop cooling system. Such cooling systems include a closed coolant loop that recirculates coolant through the engine block. Heat in the coolant is removed by passing the coolant through a heat exchanger. Typically, raw sea water from a body of water is pumped through the heat exchanger to remove heat from the engine coolant. The sea water is then discharged into the body of water. A closed loop system of this type protects the engine from the corrosive effect of raw sea water.

Closed loop cooling systems usually have a thermostat that controls the flow of engine coolant through the heat exchanger. When the temperature of the coolant is below a thermostat set temperature, all of the engine coolant bypasses the heat exchanger. When the temperature of the coolant reaches the thermostat set temperature, the thermostat opens and engine coolant flows through the heat exchanger to remove heat from the coolant. The coolant is then recirculated through the engine by a circulating pump. Even when the thermostat opens, a portion of the coolant typically bypasses the heat exchanger.

The thermostat set temperature is usually about 160° F. When the engine is initially started, the engine coolant is at ambient temperature which is below the temperature needed to open the thermostat. Therefore, at initial startup, all of the engine coolant bypasses the heat exchanger. In most systems, the bypass flow rate is low, such as approximately 7 to 8 gallons per minute. If the operator of the boat decides to open up the throttle when the engine is still cold, the flow rate through the bypass is so low that hot spots can develop in the engine because the engine is inadequately cooled until the thermostat opens.

One way to combat this problem is to provide an additional bypass for the engine coolant when the thermostat has yet to open. A particularly effective way of providing an additional bypass is disclosed in copending patent application, filed on even date herewith, now U.S. Pat. No. 5,642,691 which issued on Jul. 1, 1997. "Thermostat Assembly For A Marine Engine With Bypass", by Bruce A. Schroeder, now U.S. Pat. No. 5,642,691, assigned to the assignee of this application, and incorporated by reference herein.

Providing an additional bypass increases the flow rate of engine coolant throughout the engine while the engine is warming up. However, the increased bypass flow rate of coolant can create cavitation within the system and can create negative pressures at the inlet for the circulating pump.

SUMMARY OF THE INVENTION

The invention is directed to an improved heat exchanger assembly for a closed loop cooling system in a marine propulsion system which eliminates problems associated with increased bypass flow rate of coolant.

The preferred heat exchanger assembly includes an outer shell surrounding a plurality of internal tubes. The tubes are located longitudinally through the heat exchanger body between two sets of end chambers. Sea water enters a heat exchanger sea water inlet and flows through the heat exchanger along a sea water flow path. In the preferred embodiment of the invention, the sea water flows through the tubes and end chamber in a serpentine flow path. The sea water passing through the heat exchanger removes heat from coolant flowing through an interior of the heat exchanger body surrounding the tubes.

Coolant thus enters the heat exchanger body through a heat exchanger coolant inlet, flows through the interior of the heat exchanger body along a coolant flow path which can include baffles, and exits the heat exchanger after heat has been removed through a heat exchanger coolant outlet.

From the heat exchanger coolant outlet, coolant flows to the circulating pump.

The heat exchanger coolant outlet includes a bypass inlet and an auxiliary inlet. The bypass inlet provides a path for coolant to flow directly into the heat exchanger coolant outlet without passing through the heat exchanger.

The heat exchanger assembly further includes an integrally mounted top tank connected to the exterior of the heat exchanger body. A venting orifice in the heat exchanger body allows air and a limited amount of coolant to flow from the coolant flow path in the heat exchanger into the top tank.

A top tank coolant outlet is connected to the auxiliary inlet on the heat exchanger coolant outlet. This connection allows coolant to flow from the top tank to the heat exchanger coolant outlet when the pressure at the heat exchanger coolant outlet drops a sufficient amount. The top tank includes a pressure cap to relieve pressure within the top tank. The pressure cap support body is connected to a coolant reservoir or recovery bottle. When the pressure at the heat exchanger coolant outlet drops sufficiently, coolant is drawn from the coolant reservoir through the top tank into the closed loop cooling system.

In order to prevent the circulating pump from drawing excessively from the coolant bypass flow, the auxiliary inlet to the heat exchanger coolant outlet is located downstream of the bypass inlet. Further, the auxiliary inlet can include a top wall extending into the heat exchanger coolant outlet which can hydrodynamically create an enhanced ability to draw coolant from the top tank.

With the invention, there are increased capabilities to draw coolant, both through the heat exchanger and from the top tank of the heat exchanger. In this manner, the closed loop cooling system is able to operate with greater bypass flow rates without compromising performance.

Other objects and advantages will appear during the course of the following description.

BRIEF DESCRIPTION OF THE DRAWINGS

The drawings illustrate the best mode presently contemplated of carrying out the invention.

In the drawings.

DETAILED DESCRIPTION OF THE DRAWINGS

Figure 1:
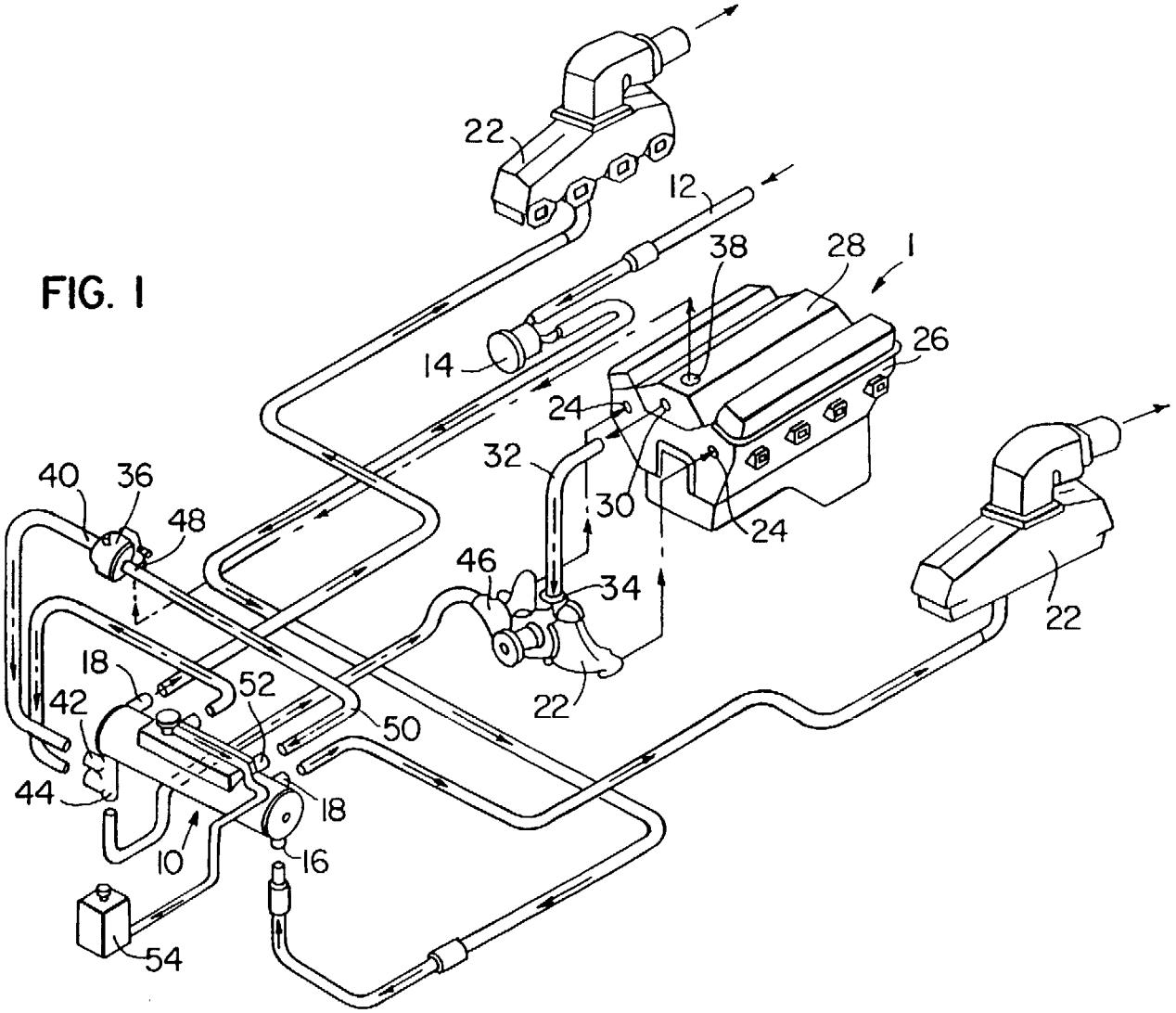
FIG. 1 is a schematic view of a closed loop cooling system for a marine engine, including a heat exchanger in accordance with the invention.

FIG. 1 shows a closed loop cooling system for an internal combustion engine 1 in a marine propulsion system. A heat exchanger assembly in accordance with the invention is generally designated by reference numeral 10.

Raw sea water, as represented by solid arrows in FIG. 1, is introduced into the system through a sea water supply 12, and is circulated by a sea water pump 14. Sea water is pumped to a sea water inlet 16 on the heat exchanger 10. The sea water flows through the heat exchanger 10 and exits through a pair of sea water outlets 18. The sea water passing through the heat exchanger 10 removes excess heat from engine coolant also passing through the heat exchanger 10. Sea water leaving the heat exchanger 10 flows through a pair of exhaust manifolds 22 and is discharged into the lake or sea. In this manner, sea water, which oftentimes includes salt and other corrosive agents, can be used to cool the engine, but does not flow through the engine 1, thus reducing unwanted corrosion within the engine 1.

The flow of engine coolant through the system is represented by broken arrows in FIG. 1. A circulating pump 22 supplies engine coolant through a pair of openings 24 in the engine block 26. The engine coolant circulates through the engine block 26 to cool the engine and piston heads contained therein. Engine coolant exits the engine block 26 through two openings 30 and 38 in the intake manifold 28.

The first opening 30 in the intake manifold 28 is a direct engine bypass opening 30. Coolant exiting the engine through the engine bypass opening 30 flows through a bypass tube 32 directly to a bypass inlet 34 on the circulating pump 22. Some of the engine coolant therefore recirculates to the engine without passing through the heat exchanger 10 in this manner.

The second opening 38 in the intake manifold 28 is a thermostat port 38. The thermostat port 38 passes through the top of the intake manifold 28. The thermostat port 38 supplies engine coolant to a thermostat assembly 36. The preferred thermostat assembly 36 is described in above-incorporated, U.S. Pat. No. 5,642,691 which issued Jul. 1, 1997, entitled "Thermostat Assembly For A Marine Engine With Bypass", by Bruce A. Schroeder, now U.S. Pat. No. 5,642,691, and assigned to the assignee of this application. When the temperature of the engine coolant is below a thermostat set temperature (e.g. 160° F.), the thermostat remains closed and the engine coolant flows through a bypass outlet 40 in the thermostat assembly 36. The thermostat bypass outlet 40 is connected through a tube to a heat exchanger bypass inlet 42 on a coolant outlet 44 from the heat exchanger 10. The heat exchanger coolant outlet 44 is connected to the coolant inlet 46 for the circulating pump 22. Thus, the thermostat bypass outlet 40 in the thermostat assembly 36 provides an additional path for engine coolant to bypass the heat exchanger 10 and return directly to the circulating pump 22.

When the temperature of the engine coolant reaches the thermostat set temperature, the thermostat 36 opens and allows engine coolant to flow through a thermostat outlet 48, through a heat exchanger supply tube 50, and eventually into a coolant inlet 52 for the heat exchanger 10. From the coolant inlet 52, engine coolant flows through the heat exchanger 10 and excess heat in the coolant transfers to sea water passing through the heat exchanger 10. The engine coolant exits the heat exchanger 10 through the coolant outlet 44, and flows to the coolant inlet 46 for the circulating pump 22.

An additional supply of engine coolant is contained in a coolant recovery bottle 54. Engine coolant from the coolant recovery bottle 54 is used to replenish coolant that has been lost from the cooling system.

Figure 2:
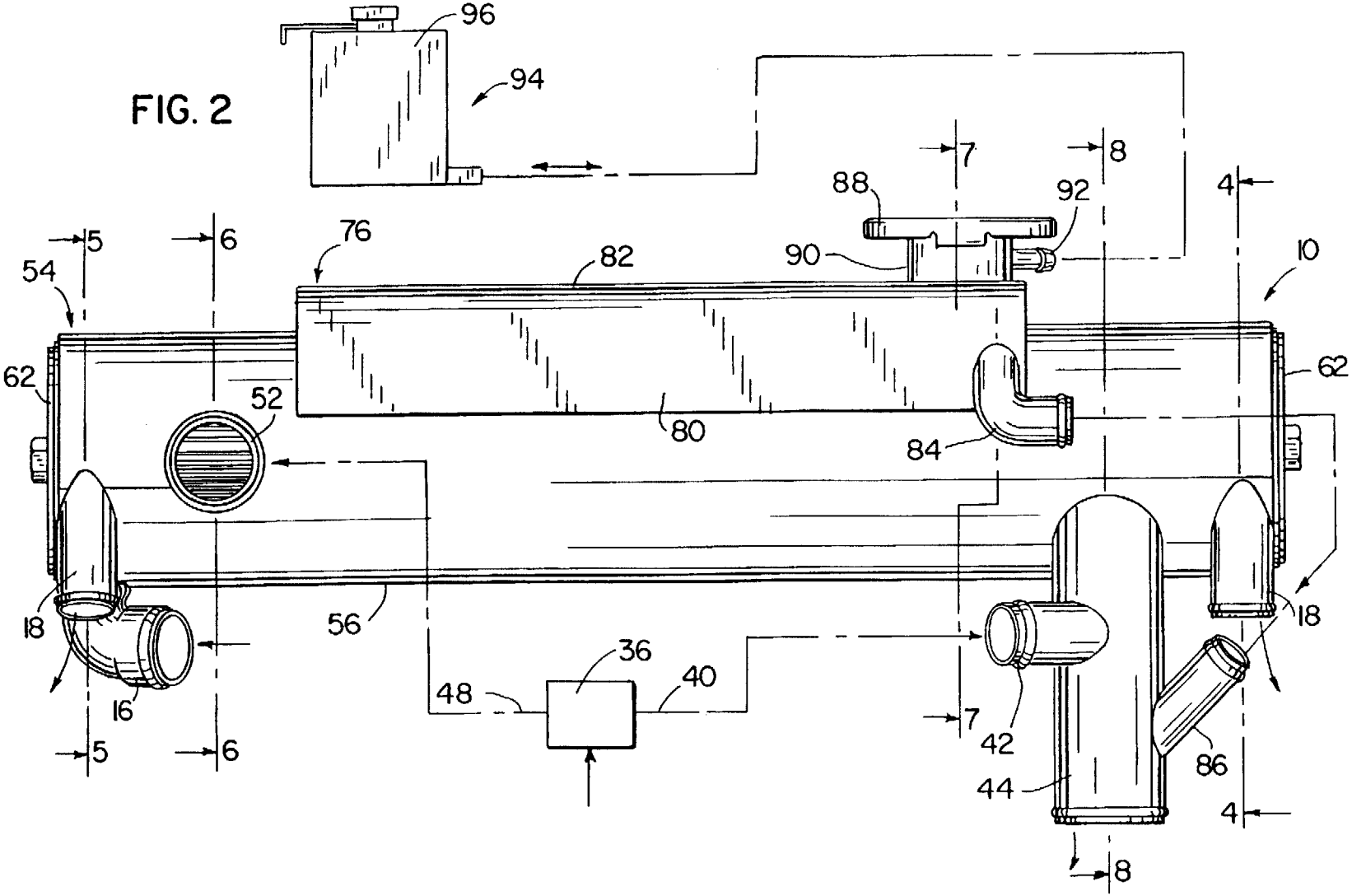
FIG. 2 is a side view of the heat exchanger shown in FIG. 1.

Referring to FIG. 2, the heat exchanger 10 generally includes a standard shell and tube body 54. An outer wall 56 defines a generally cylindrical structure having a plurality of inlet and outlet openings. In the preferred embodiment of the invention, the outer wall 56 is constructed of copper and has a 4 inch diameter, although various other materials and sizes can be selected.

As can be seen in FIGS. 3 through 8, the outer wall 56 defines an open interior 58. A plurality of sea water tubes 60 are contained within the open interior 58 of the heat exchanger 10. The sea water tubes 60 extend longitudinally within the body 54 of the heat exchanger 10. The outer surfaces of the sea water tubes 60 are structurally connected to one another at each end by a series of welds 61. Besides the welded ends, the tubes 60 are not connected to each other, thus allowing coolant to flow therebetween.

Figure 3:
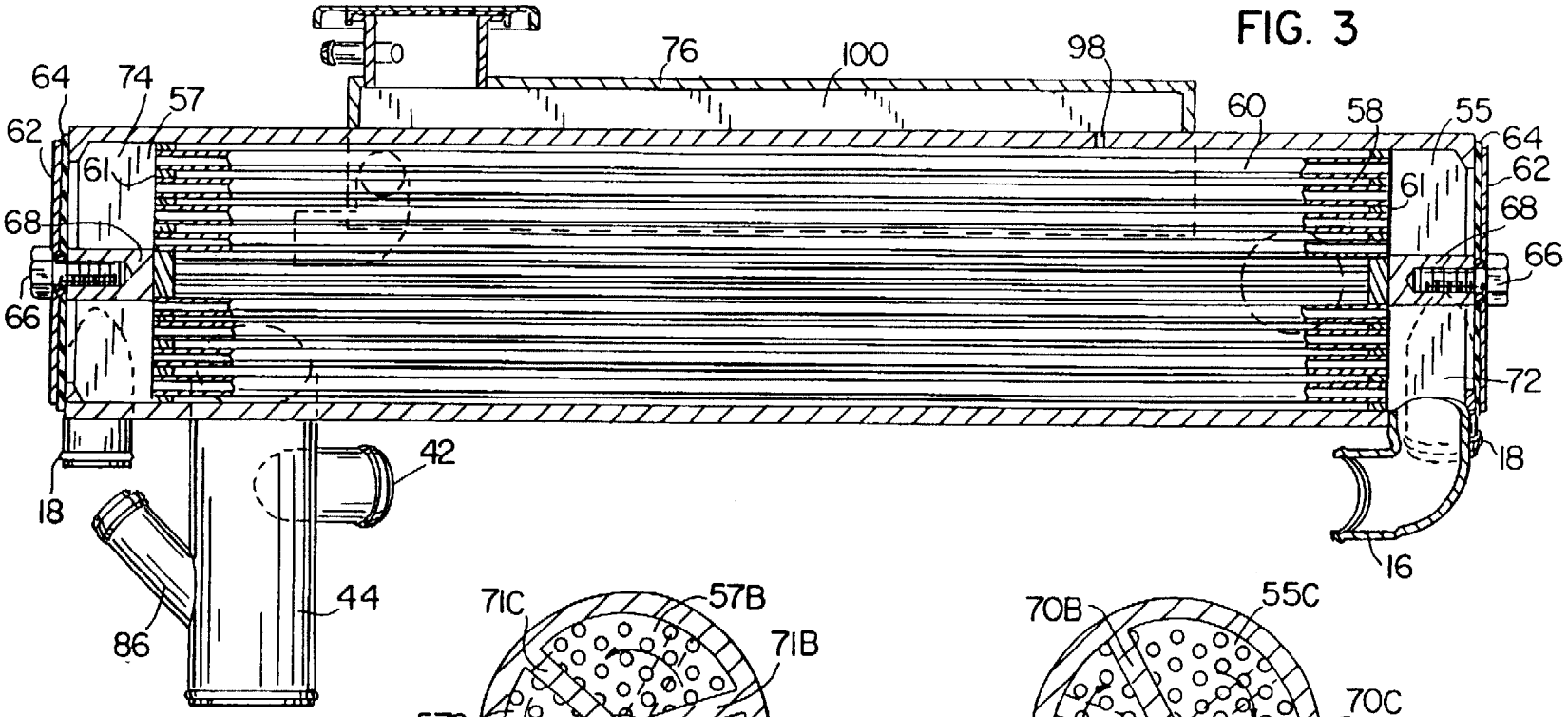
FIG. 3 is a side sectional view of the heat exchanger.

As can be seen in FIG. 3, the bundle of tubes 60 extends nearly the entire longitudinal length of the body 54 and the tubes 60 are evenly spaced axially within the body 54. A first set of end chambers 55 is located on the end of the heat exchanger 10 near the sea water inlet 16, and a second set of end chambers 57 is located on the other end of the heat exchanger 10. The open interior 58 of the heat exchanger 10 is located between the first 55 and second 57 sets of end chambers.

Figure 5:
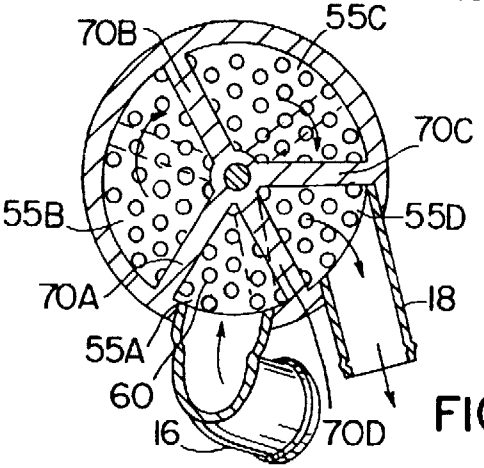
FIG. 5 is a sectional view taken along line 5—5 of FIG. 2.
Figure 4:
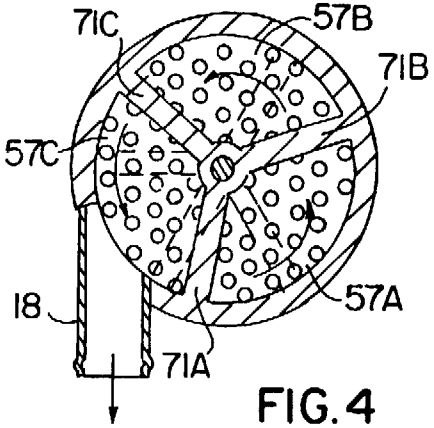
FIG. 4 is a sectional view taken along line 4—4 of FIG. 2.

Connected to each end of the body 54 is an end piece 62 and a water-tight gasket 64. Each of the end pieces 62 are connected to the body 54 by a screw connector 66 that engages a connection member 68. Each connection member 68 is supported by a series of divider walls 70A–D and 71A–C, see FIGS. 4 and 5. As can be seen in FIGS. 4 and 5, the construction and orientation of the divider walls 70A–D, 71A–C differ on each end of the heat exchanger body 54.

Divider walls 70A–70D separate the first set of end chambers 55 into four separate end chambers 55A, 55B, 55C and 55D. Divider walls 71A–71C separate the second set of end chambers 57 into a series of separate end chambers 57A–57C. The position of the end chambers 55A–55D is offset with respect to the position of end chambers 57A–57C so that the sea water flows back and forth through a portion of the heat exchanger tubes 60, either five or six times before discharging through the sea water outlets 18.

Sea water flowing into the heat exchanger 10 through inlet 16 flows into end chamber 55A, and then through the sea water heat exchanger tubes 60 having an end open to end chamber 55A. When the sea water reaches the other end of the heat exchanger 10, the sea water flows into end chamber 57A. The sea water continues to flow through the heat exchanger 10 by flowing through tubes 60 which open to end chamber 57A. The flow of sea water continues to serpentine through the heat exchanger 10 by flowing through tubes 60 into end chambers 55B, 57B, 55C, and eventually to end chambers 57C or 55D. A portion of the sea water in end chamber 57C exits through sea water outlet 18, FIG. 4, and the remaining portion exits the heat exchanger 10 through end chamber 55D and sea water outlet 18, FIG. 5.

Figure 6:
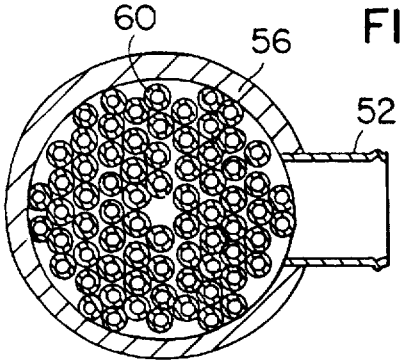
FIG. 6 is a sectional view taken along line 6—6 of FIG. 2.

An engine coolant inlet 52 for the heat exchanger 10, FIGS. 2 and 6, passes through outer wall 56 of the body 54 of heat exchanger 10. As shown in FIG. 2, the coolant inlet 52 is located at approximately the mid-point between the top and bottom of the heat exchanger body 54, and is spaced inwardly from the end piece 62 located at the end of the heat exchanger 10 having end chambers 57A through 57D. Coolant is supplied to the coolant inlet 52 from the thermostat outlet 48 of the thermostat assembly 36. The coolant inlet 52 allows coolant to enter the open interior 58 of the heat exchanger body 54 around the heat exchanger tubes 60.

Coolant flows through the longitudinal length of the open interior 58 of the heat exchanger body 54, thus flowing through the space between the sea water tubes 60, FIG. 6. The sea water tubes 60 remove heat from the engine coolant passing between the tubes 60. The coolant can be directed through the open interior 58 by a series of baffles, which are not shown but are well known in the prior art. A series of baffles can extend between the top and bottom of the body 54, and create turbulent flow within the body 54 thereby increasing the heat transfer rate.

Upon flowing through the open interior 58 of the heat exchanger 10, the coolant exits the heat exchanger body 54 through the heat exchanger coolant outlet 44, which passes through the outer wall 56 of the heat exchanger 10. Coolant exiting through the heat exchanger coolant outlet 44 flows to the circulating pump 22 to be recirculated to the engine.

Figure 7:
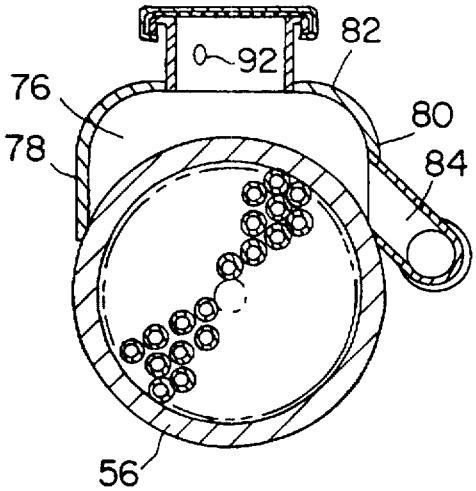
FIG. 7 is a sectional view taken along line 7—7 of FIG. 2.
Figure 8:
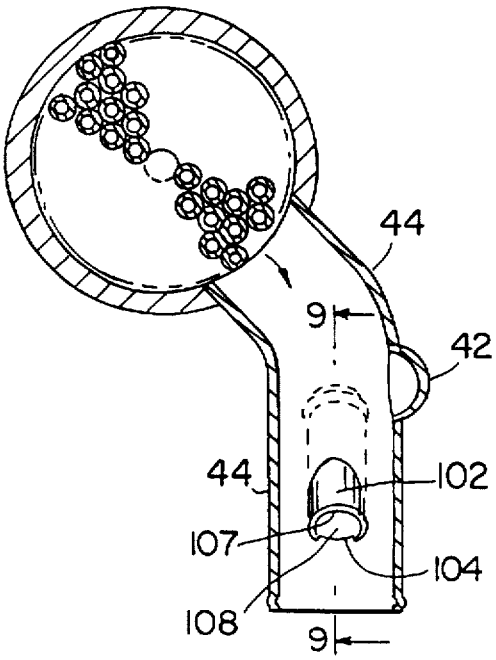
FIG. 8 is a sectional view taken along line 8—8 of FIG. 2.

Connected to the top of the heat exchanger body 54 is a top tank 76, FIGS. 2, 3 and 7. The top tank 76 consists of a pair of vertical walls 78,80 and a horizontal top wall 82. As can be seen in FIG. 2, the overall length of the top tank 76 is less than the overall length of the heat exchanger body 54. A top tank outlet 84 is connected through the vertical wall 80 and provides a means for coolant to flow from the top tank 76, FIG. 7. The top tank outlet 84 is connected by a flexible tube (not shown) to an auxiliary inlet 86 on the heat exchanger coolant outlet 44. The connection between the top tank outlet 84 and the auxiliary tank 86 allows coolant in the top tank 76 to flow into the heat exchanger coolant outlet 44.

The bypass inlet 42, which receives coolant from the thermostat bypass outlet 40, enters the heat exchanger coolant outlet 44 at a location upstream of the auxiliary inlet 86.

A pressure cap 88 is connected to a cylindrical support body 90 surrounding an opening in the top tank 76 and extending from the top wall 82 of the tank 76. The pressure cap 88 relieves excessive air pressure in the top tank 76. A reservoir connection 92 communicating with the coolant recovery bottle 96 is provided through the cylindrical support body 92.

Referring now to FIG. 3, a top tank venting orifice 98 provides a flow path for coolant from the open interior 58 around the heat exchanger tubes 60 into the top tank 76. The diameter of the top tank venting orifice 98 is selected to be small enough to prevent an excessive amount of coolant from flowing into the top tank 76, yet large enough to prevent small particles or debris from completely clogging the orifice 98. In the preferred embodiment of the invention, the diameter of the top tank venting orifice 98 is selected in the range of 0.01–0.20 inches. Specifically, an orifice 98 with a diameter of 0.109 inches has been determined to operate most effectively.

Engine coolant flowing through the spaces between the sea water tubes 60 passes by the orifice 98. If a series of baffles are used within the open interior 58 of the heat exchanger body 54, the flow of coolant can be directed close to the orifice 98. Since the orifice 98 passes through the top of the heat exchanger body 54, air contained within the engine coolant loop vents to the top tank 76 through the orifice 98.

In the cooling system shown in FIG. 1 which includes a thermostat housing 36 with a bypass outlet 40, the flow rate of engine coolant throughout the system is relatively high. If a conventional heat exchanger without a top tank is used, the pressure under the pressure cap 88 keeps the center valve of the pressure cap 88 from opening, and prevents coolant from entering the system during high engine speeds. Using a top tank 76 as described herein shields the pressure cap 88 from high velocity coolant flow, and therefore allows the pressure cap 88 to operate properly. Also, using a conventional heat exchanger without a top tank in the system shown in FIG. 1, leads to the creation of negative pressure at the circulating pump inlet 46, which can reduce the performance of the circulating pump 22. Negative pressure at the circulating pump inlet 46 is created because the bypass 40 in the thermostat housing 36 effectively joins the engine block 26 to the circulating pump 22 at a location below the pressure cap 88. Without the top tank 76, and the top tank outlet 84 connected to the auxiliary inlet 86 on the heat exchanger coolant outlet 44, the circulating pump 22 is likely to draw coolant from the bypass 40 in the thermostat housing 36 through the bypass inlet 42 in the heat exchanger coolant outlet 44. Without the alternate flow path from the top tank 76 provided by the top tank outlet 84, the flexible tube and the auxiliary inlet 86, the flow of coolant through the bypass inlet 42 offers a less restrictive supply of coolant than via the pressure cap 88.

The invention provides a solution to this problem. When negative pressure develops at the circulating pump inlet 46, the system draws additional coolant in through the auxiliary inlet 86 on the heat exchanger coolant outlet 44, which is in communication with the coolant recovery bottle 96 through the reservoir connection 92. Since the auxiliary inlet 86 is located downstream of the bypass inlet 42, the system draws coolant through the auxiliary inlet 86 rather than drawing coolant through the bypass inlet 42.

Figure 9:
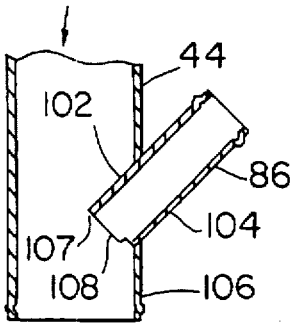
FIG. 9 is a sectional view taken along line 9—9 of FIG. 8.

Additionally, as can be seen in FIGS. 9 and 10, the auxiliary inlet 86 extends into the coolant outlet 44 at an acute angle. The top wall 102 of the auxiliary inlet 86 preferably extends into the interior of the heat exchanger coolant outlet 44, and therefore extends into the flow path of engine coolant passing through the coolant outlet 44. The bottom wall 104 of the auxiliary inlet 86 stops at the outer wall 106 of the coolant outlet 44. An extended lip 107 is therefore created in the interior of the coolant outlet 44. As engine coolant passes by the extended lip 107, the flow of coolant creates a vortex near the outer wall 106 and slightly below the opening 108 to the auxiliary inlet 86. This vortex creates a point of low pressure which increases the capability of the system to further draw engine coolant into the system from the recovery bottle 96.

The invention allows an increased engine coolant flow throughout the closed loop cooling system. As a result, other cooling systems in the marine propulsion system, such as an oil cooler, are not required to remove as much heat from the engine. Additionally, the heat exchanger 10 of the invention increases the drawing capabilities of the closed loop cooling system, thereby increasing efficiency of the system and eliminating other problems that can be associated with closed loop cooling systems with high coolant flow rates.

Various modes of carrying out the invention are contemplated as being within the scope of the following claims.

We claim:

1. A heat exchanger in a closed loop cooling system for an internal combustion engine in a marine propulsion system, comprising:

a heat exchanger body having a coolant flow path and a sea water flow path;

a heat exchanger sea water supply inlet (16) that connects the sea water flow path in the heat exchanger body to a supply of raw sea water;

a heat exchanger coolant inlet (82) connects the coolant flow path in the heat exchanger body to a closed loop of engine coolant;

a top tank integrally mounted to an exterior of the heat exchanger body, the top tank having a top tank coolant outlet (84), a top tank venting orifice in the heat exchanger body that allows air and coolant to flow from the coolant flow path in the heat exchanger body into the top tank;

a heat exchanger sea water outlet that allows sea water to exit from the sea water flow path in the heat exchanger body;

a heat exchanger coolant outlet that allows coolant to exit the coolant flow path in the heat exchanger body;

a bypass inlet connected to the heat exchanger coolant outlet, the bypass inlet allowing coolant to selectively bypass the heat exchanger body; and an auxiliary inlet connected to the heat exchanger coolant outlet, the auxiliary inlet being in fluid communication with the top tank coolant outlet.

2. The heat exchanger of claim 1, wherein the top tank further comprises a pressure cap for alleviating air pressure in the top tank.

3. The heat exchanger of claim 1, wherein the auxiliary inlet is connected to the heat exchanger coolant outlet downstream of the bypass inlet.

4. The heat exchanger of claim 3, wherein a flow control lip is located within the heat exchanger coolant outlet upstream of the auxiliary inlet and downstream of the bypass inlet, the flow control lip reducing the coolant pressure downstream from the lip.

5. The heat exchanger of claim 1, wherein said top tank includes a reservoir connection joining the top tank to an external source of coolant.

6. The heat exchanger of claim 1, wherein engine coolant is supplied to the heat exchanger coolant inlet from a thermostat assembly that controls the flow of engine coolant to the heat exchanger depending on the temperature of the engine coolant.

7. The heat exchanger of claim 6, wherein the bypass inlet receives coolant from a bypass outlet contained in a housing of the thermostat assembly.

8. The heat exchanger of claim 1 wherein the heat exchanger body is a shell and tube heat exchanger body.

9. The heat exchanger of claim 1 wherein the heat exchanger body is a shell and tube heat exchanger in which:

a plurality of longitudinal tubes communicating between a plurality of end chambers define the sea water flow path through the heat exchanger body; and an open interior within the heat exchanger body between the end chambers and surrounding the longitudinal tubes defines the coolant flow path through the heat exchanger body.

10. The heat exchanger of claim 1, wherein said top tank supply orifice is of a diameter in the range of 0.01–0.20 inches.

11. A closed loop cooling system for an internal combustion engine in a marine propulsion system, comprising:

a circulating pump for circulating the engine coolant throughout the engine;

a thermostat assembly receiving a flow of engine coolant from the engine, the thermostat assembly having a thermostat and a thermostat housing, the housing having a bypass outlet and a thermostat outlet; and a a heat exchanger having;

a heat exchanger body having a coolant flow path and a sea water flow path;

a heat exchanger sea water supply inlet that connects the sea water flow path in the heat exchanger body to a supply of raw sea water;

a heat exchanger coolant inlet that connects the coolant flow path to the thermostat outlet of the thermostat housing;

a top tank integrally mounted to an exterior of the heat exchanger body, the top tank having a top tank coolant outlet;

a top tank venting orifice in the heat exchanger body that allows air and coolant to flow from the coolant flow path in the heat exchanger body into the top tank;

a heat exchanger sea water outlet that allows sea water to exit from the sea water flow path in the heat exchanger body;

a heat exchanger coolant outlet that allows coolant to exit the coolant flow path in the heat exchanger body and flow to the circulating pump;

a bypass inlet on the heat exchanger coolant outlet which connects the bypass outlet of the thermostat housing to the heat exchanger coolant outlet and allows coolant to selectively bypass the heat exchanger body; and an auxiliary inlet connected to the heat exchanger coolant outlet, the auxiliary inlet being in fluid communication with the top tank coolant outlet.

* * * * *

UNITED STATES PATENT AND TRADEMARK OFFICE

CERTIFICATE OF CORRECTION

PATENT NO. : 5,746,270

DATED : May 5, 1998

INVENTOR(S) : BRUCE A. SCHROEDER ET AL.

It is certified that error appears in the above-indentified patent and that said Letters Patent is hereby corrected as shown below:

Claim 1, Col. 7, Line 9, delete "(16)"; Claim 1, Col. 7, Line 12, delete "(82)" and substitute therefor ---that---; Claim 1, Col. 7, Line 17, delete "(84)"; Claim 11, Col. 8, Line 23, after "outlet; and" delete "a"; Claim 11, Col. 8, Line 24, After "having" delete ";" and substitute therefor ---:---.

Signed and Sealed this

Twenty-fifth Day of August, 1998

*Attest:*

*Attesting Officer*

BRUCE LEHMAN

*Commissioner of Patents and Trademarks*